US005138223A

United States Patent [19]

Osada et al.

[11] Patent Number: 5,138,223

[45] Date of Patent: Aug. 11, 1992

[54] TUBULAR FLUORESCENT LAMP WITH INTERMEDIATE ELECTRODE

[75] Inventors: Kimio Osada, Yokosuka; Takeo Yasuda, Yokohama, both of Japan

[73] Assignee: Toshiba Lighting & Technology Corporation, Tokyo, Japan

[21] Appl. No.: 538,670

[22] Filed: Jun. 15, 1990

[30] Foreign Application Priority Data

| | | | |
|---|---|---|---|
| Jun. 17, 1989 | [JP] | Japan | 1-155219 |
| Jun. 17, 1989 | [JP] | Japan | 1-155220 |
| Aug. 30, 1989 | [JP] | Japan | 1-221562 |

[51] Int. Cl.[5] ..... H01J 61/42; H01J 61/32; H01J 61/04

[52] U.S. Cl. ..... 313/488; 313/492; 313/493

[58] Field of Search ..... 313/493, 488, 492

[56] References Cited

U.S. PATENT DOCUMENTS

| | | | |
|---|---|---|---|
| 2,102,190 | 12/1937 | Barclay | 313/210 X |
| 2,267,118 | 12/1941 | Marden | 313/493 X |
| 4,208,618 | 6/1980 | Heine | 313/493 |
| 4,335,331 | 6/1982 | Watanabe et al. | 313/493 X |
| 4,524,301 | 6/1985 | Cohen et al. | 313/493 |
| 4,665,341 | 5/1987 | Imamura et al. | 313/493 |
| 4,695,763 | 9/1987 | Ogasawara et al. | 313/488 X |
| 4,743,799 | 5/1988 | Loy | 313/493 |
| 4,961,024 | 10/1990 | Kodama et al. | 313/493 |

FOREIGN PATENT DOCUMENTS

| | | | |
|---|---|---|---|
| 0203246 | 12/1986 | European Pat. Off. . | |
| 3333643 | 4/1985 | Fed. Rep. of Germany | 313/493 |
| 3437212 | 4/1986 | Fed. Rep. of Germany | 313/493 |
| 59-186245 | 10/1984 | Japan . | |
| 91546 | 5/1985 | Japan | 313/488 |
| 163555 | 7/1986 | Japan | 313/488 |
| 250957 | 11/1986 | Japan | 313/488 |
| 440945 | 1/1936 | United Kingdom . | |
| 2167895 | 6/1986 | United Kingdom . | |

*Primary Examiner*—Palmer C. DeMeo
*Attorney, Agent, or Firm*—Cushman, Darby & Cushman

[57] ABSTRACT

In a fluorescent lamp, a curved discharge path is constituted by a plurality of bulbs and a cap interconnecting end portions of the bulbs. Terminal electrodes are provided at end portions of the bulbs, which are situated at both ends of the discharge path. An intermediate electrode is arranged within the cap. A voltage is applied selectively between the intermediate electrode and the terminal electrodes, thereby selectively enabling the bulbs to emit light. The bulbs may have apertures having different widths and positions. Different types of phosphor layers may be formed on the inner surfaces of the bulbs, thereby selectively emitting light of different wavelengths.

6 Claims, 9 Drawing Sheets

TUBULAR FLUORESCENT LAMP WITH INTERMEDIATE ELECTRODE

BACKGROUND OF THE INVENTION

1. Field of the Invention

The present invention relates generally to a fluorescent lamp having a curved discharge path, such as a U-shaped path or a W-shaped path, and more particularly to a fluorescent lamp having a plurality of bulbs, the ends of which are connected by a cap, wherein the bulbs and the cap form a U-shaped, S-shaped, or W-shaped discharge path.

2. Description of the Related Art

A fluorescent lamp is used not only as a general room light source, but also as a special light source for various purposes.

For instance, a fluorescent lamp is employed as a "back light" for a liquid crystal display, which illuminates the rear surface of the display. In addition, the lamp is used as a light source in a copying machine, or other special light sources.

When the fluorescent lamp is employed as the back light for the liquid crystal display, it is necessary that the lamp illuminate the rear surface of the display almost uniformly. For this end, a number of straight-bulb fluorescent lamps are arranged in parallel, or a fluorescent lamp having a U-shaped or W-shaped bulb is employed.

When many straight-bulb fluorescent lamps are juxtaposed, many sockets and lamp holders are needed, and complicated wiring is required.

Under the circumstances, fluorescent lamps having U-shaped, S-shaped, or W-shaped bulbs are widely used. In this case, with use of a single lamp, a wide area can be uniformly illuminated.

Although the use of this single fluorescent lamp with a curved bulb reduces the number of sockets and simplifies the wiring, it is difficult to manufacture a bulb of such a complex shape.

On the other hand, there is known a so-called aperture-type fluorescent lamp which may be used as a back light for a liquid-crystal display. When a fluorescent lamp is used as a back light, it is not necessary that the bulb of the lamp emit light from its entire peripheral area. It suffices if light is emitted from only a given portion of its periphery. Taking this into consideration, the aperture-type fluorescent lamp has a slit-like aperture (opening) extending continuously in the axial direction of the bulb of the lamp. Phosphor is not coated on that part of the bulb, which corresponds to the aperture. A reflective coating layer is formed on that part of the outer surface of the bulb, which corresponds to the remaining inner surface of the bulb that is coated with phosphor. In the aperture-type fluorescent lamp, light emitted from the phosphor-coated part is reflected by the reflective coating layer, and most of the light is radiated through the aperture only in a predetermined circumferential range. Thus, the aperture-type fluorescent lamp can efficiently emit light only onto an area requiring light illumination.

An aperture-type fluorescent lamp having a curved bulb is manufactured in the following manner. First, a straight bulb is prepared. The inner surface of the bulb, excepting the area of a slit-like aperture, is coated with phosphor, and a reflective layer is coated on the outer surface of the bulb which corresponds to the phosphor-coated inner surface. The finished bulb is heated and partly bent in a U-shape or a W-shape.

When the aperture-type fluorescent lamp is employed as a back light for a liquid-crystal display, it is necessary, in some cases, to vary the axial length of the aperture or to change the position of the aperture in the circumferential direction of the bulb, in order to attain uniform illumination. In the case of the fluorescent lamp having the curved bulb, however, it is difficult to vary the length of the aperture and/or change the circumferential position of the aperture over the entire axis of the bulb.

When a plurality of fluorescent lamps having straight bulbs are arranged in parallel, as has been mentioned above, it is possible to turn on only some of them to change the amount of light and/or luminous intensity distribution. In the case of the fluorescent lamp having the curved bulb, however, it is not possible to turn on only a portion the bulb.

In the case where a fluorescent lamp is used as a light source in a copying machine, it is necessary, in some cases, to vary the wavelength of light in accordance with the color tone, etc. of an original to be copied. In a light source device wherein a plurality of fluorescent lamps are arranged in parallel, it is possible to arrange fluorescent lamps capable of emitting light of various wavelengths and to selectively turn on them to change the wavelength of emitted light. This is impossible, however, in the case of the fluorescent lamp having the curved bulb.

In addition, in the case of the fluorescent lamp with the curved bulb, a positive column generated in the bulb departs from the center of the cross section of the bulb towards the inner side of the curved portion. As a result, non-uniform light is emitted from the curved portion of the bulb.

SUMMARY OF THE INVENTION

The object of the present invention is to solve the aforementioned drawbacks in the fluorescent lamp having a curved bulb.

In order to achieve the object, in this invention, a plurality of substantially straight bulbs are arranged substantially in parallel. End portions of the bulbs are coupled by means of a cap. A curved discharge path extends through the bulbs and the cap.

According to this structure, a curved discharge path or bulb can be manufactured with simple steps.

According to preferred embodiments of this invention, the width and circumferential position of an aperture formed in each bulb are easily varied, and emitted light is freely distributed and controlled.

Further, an intermediate electrode is provided within the cap, and a voltage is selectively applied between the intermediate electrode and terminal electrodes, thereby causing electric discharge to take place selectively in the bulbs and selectively enabling the bulbs to emit light.

Further, the types of phosphor coating layers coated on the inner surfaces of the bulbs are made to differ from each other, so that the phosphor coating layers may emit light of different wavelengths.

Further, a member is provided in a connection part between the bulbs and the cap, communication ports are formed in the member to allow the inside of the bulbs to communicate with the inside of the cap, and each communication port is displaced from the center of the cross section of each bulb towards the outside of a curved area of the discharge path. Thus, the inward displacement of the positive column in the curved area is compensated, and the positive column is kept at the center of each bulb.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENT

Figure 1:
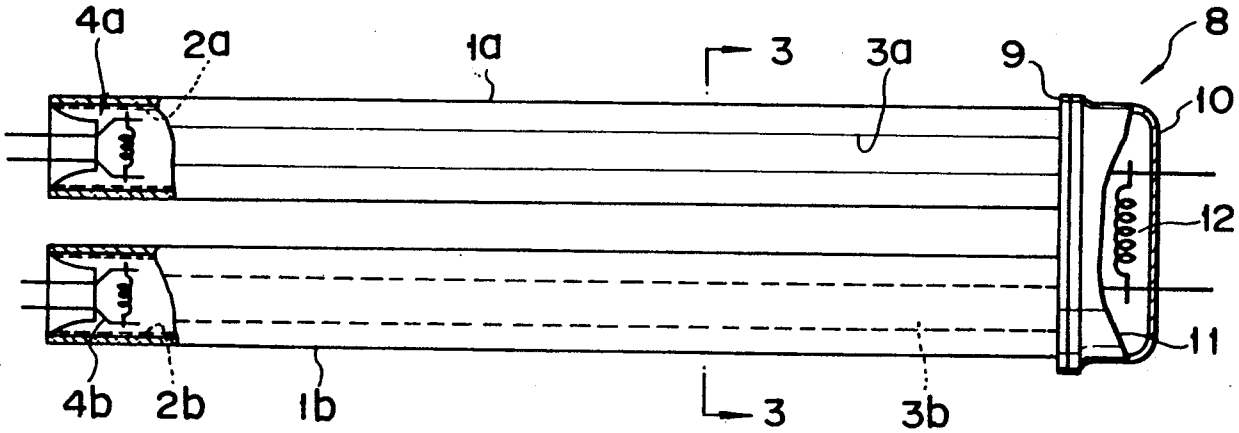
FIG. 1 is a side view of an aperture-type fluorescent lamp having a U-shaped discharge path, according to a first embodiment of the present invention.
Figure 3:
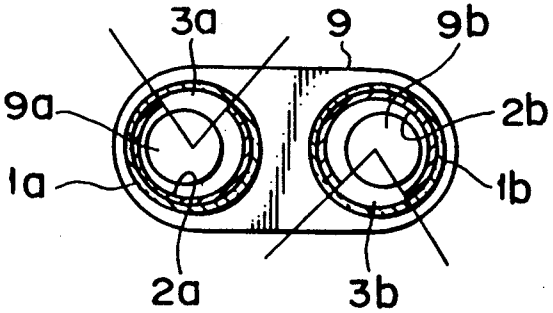
FIG. 3 is a cross-sectional view taken along line 3—3 in FIG. 1.
Figure 2:
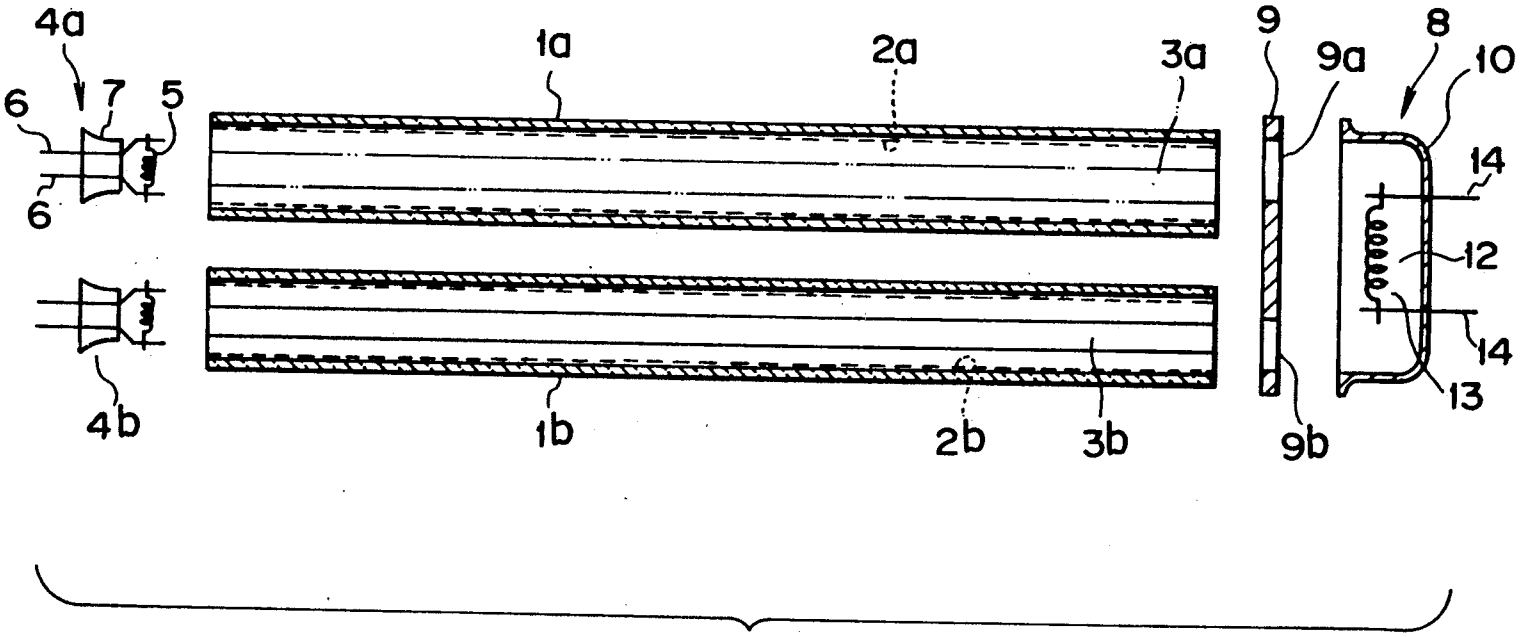
FIG. 2 is an exploded, vertical cross-sectional view of the fluorescent lamp shown in FIG. 1.

Preferred embodiments of the present invention will now be described with reference to the accompanying drawings. FIGS. 1 through 3 show an aperture-type fluorescent lamp having a U-shaped discharge path according to a first embodiment of the present invention.

Phosphor layers 2*a* and 2*b* are coated on the inner surface of light emission bulbs 1*a* and 1*b*. In this embodiment, the bulbs 1*a* and 1*b* are of the straight type.

The phosphor layers 2*a* and 2*b* may be formed of the same material. For instance, a well-known three-wavelength phosphor material, made by mixing phosphors of three primary colors, blue (B), green (G) and red (R), is used. Alternatively, the phosphor layers 2*a* and 2*b* may be formed of phosphors of different colors. For instance, the phosphor layer 2*a* is formed of one of the blue, green and red phosphors, and the phosphor layer 2*b* is formed of the others.

A predetermined area of the inner surface of each bulb, 1*a* and 1*b*, which extends in its circumferential direction, is not coated with the phosphor layer 2*a*, 2*b*. This area serves as an aperture or light transmission slit portion 3*a*, 3*b*, through which a glass surface is exposed. The light transmission slit portion 3*a*, 3*b* extends by a predetermined distance along the axis of the bulb 1*a*, 1*b*. Namely, the bulbs 1*a* and 1*b* have axially extending light transmission slit portions 3*a* and 3*b*. In this embodiment, the lengths of the slit portions 3*a* and 3*b* are equal, but the slit portions 3*a* and 3*b* are situated in opposite directions.

The slit portions 3*a* and 3*b* form transparent portions of the glass bulbs. Thus, when the bulbs are turned on, the slit portions 3*a* and 3*b* have the brightness 1.3 to 1.5 times higher than that of the area of the phosphor layers 2*a* and 2*b*. A great amount of light is emitted from the light transmission slit portions 3*a* and 3*b*, and the bulbs are given directivity.

The light emission bulbs 1*a* and 1*b* have, at their first ends, terminal electrodes 4*a* and 4*b* (hot cathodes in this embodiment). In each of the bulbs 1*a* and 1*b*, both ends of a filament 5 are connected to leads 6. The leads 6 penetrate a flare stem 7 hermetically. The flare stem 7 is welded to an open end portion of the bulb 1*a*, 1*b*.

Namely, the first end portions of the bulbs 1*a* and 1*b* are sealed by the terminal electrode 4*a*, 4*b*.

The second end portions of light emission bulbs 1*a* and 1*b* are connected to each other by means of a coupler 8. The coupler 8 comprises, for example, a seal plate 9 and a cap 10. The seal plate 9 is formed, for example, of an insulator material. The seal plate 9 has communication ports 9*a* and 9*b* which communicate with openings at the second ends of the bulbs 1*a* and 1*b*. The insulating seal plate 9 is hermetically connected to the openings at the second ends of the bulbs 1*a* and 1*b* by means of an adhesive (not shown).

The cap 10 is formed, for example, of an electrically conductive, non-light-transmissive material. The cap 10 is mounted on the seal plate 9, and is hermetically coupled thereto by means of an adhesive (not shown).

The space defined by the seal plate 9 and the cap 10 is allowed to communicate with the bulbs 1*a* and 1*b* through the communication ports 9*a* and 9*b* formed in the seal plate 9. Thus, the bulbs 1*a* and 1*b* and the coupler 8 constitute, as one body, a U-shaped discharge path 11.

The communication port 9*a*, 9*b* is displaced from the center of the cross section of the bulb 1*a*, 1*b*, i.e. the center of the figure of the cross section of the bulb 1*a*, 1*b*, by a predetermined distance in the outward direction in the curved region of the discharge path 11. This outward displacement of the communication port 9*a*, 9*b* compensates the tendency of inward displacement of the positive column in the curved region of the discharge path 11, thereby keeping the location of the positive column at the center of the bulb. The reason for this will now be explained. In general, the positive column tends to be kept at the center of the cross section, or the center of the figure of the cross section, of the discharge path. Thus, if the communication port 9a, 9b is displaced outwards of the curved region of the bulb, the positive column passing through the communication port 9a, 9b tends to be situated at the center of the communication port, i.e. outwards of the curved region. This tendency of outward displacement compensates the tendency of the inward displacement of the positive column in the curved region of the discharge path. As a result, the positive column is kept at the center of the discharge path 11, and accordingly at almost the center of the bulb 1a, 1b.

The degree of outward displacement of the communication port 9a, 9b is determined, depending on the diameter of the communication port 9a, 9b, the shape of the curved region, and other characteristics of the fluorescent lamp. The optimum outward displacement of the communication port 9a, 9b can be attained by calculations or experiments.

An intermediate electrode 12 serving as a third electrode is arranged within the space defined by the seal plate 9 and the cap 10. The intermediate electrode 12 is constituted such that leads 14 are connected to both ends of a filament 13 and are penetrated hermetically through the cap 10. The leads 14 are extended to the outside of the cap 10. As a matter of course, the leads 14 are electrically insulated from the cap 10.

A predetermined amount of mercury and a starting noble gas is sealed in the U-shaped discharge path 11 constituted by the bulbs 1a and 1b and the coupler 8.

In this fluorescent lamp, when the terminal electrodes 4a and 4b connected to both ends of the discharge path 11 are supplied with electric power, electric discharge is caused to occur between the terminal electrodes 4a and 4b. The electric discharge is generated over the entire length of the U-shaped discharge path 11; thus, light is emitted from the entire U-shaped discharge path 11.

In the present embodiment, however, the cap 10 is formed of non-light-transmissive material, and therefore the cap 10 emits no light. Thus, light is emitted simultaneously from the juxtaposed bulbs 1a and 1b.

The bulbs 1a and 1b emit light, as the result of the light emission of phosphor layers 2a and 2b. A predetermined circumferential portion of the bulb 1a, 1b is provided with the light transmissive slit portion 3a, 3b on which no phosphor is coated. The slit portion 3a, 3b has the brightness 1.3 to 1.5 times greater than that of the phosphor layer 2a, 2b. Thus, a greater amount of light is emitted through the slit portions 3a and 3b. In the embodiment, since the light transmissive slit portions 3a and 3b are vertically situated in opposite directions, the bulb 1a emits a greater amount of light in the upward direction and the bulb 1b emits a greater amount of light in the downward direction.

For example, when phosphor layers 2a and 2b capable of emitting light of different colors are formed on the inner surfaces of the light emission bulbs 1a and 1b, the amount of light emitted upwards differs from that of light emitted downwards. Thus, the color of light emitted upwards differs from that of light emitted downwards.

On the other hand, when electric power is supplied to the intermediate electrode 12 and one of the terminal electrodes 4a and 4b provided at both ends of the discharge path 11, for example, the terminal electrode 4a, electric discharge occurs between the electrodes 4a and 12. Thus, only one of the bulbs 1a in the U-shaped discharge path 11 is allowed to emit light.

In this case, the length of the discharge path 11, over which light is emitted, is halved substantially. Namely, the light emission area is decreased, and the amount of emitted light is almost halved. It is thus possible to illuminate a specific part of an object.

In addition, in this case, the bulb 1a having the upward light transmissive slit portion 3a can emit light mainly in the upward direction. The bulb 1a emits light of the color corresponding to the phosphor layer 2a formed on the inner surface of the bulb 1a.

When electric power is supplied to the intermediate electrode 12 and the other terminal electrode 4b, electric discharge occurs between these electrodes 12 and 4b and only the bulb 1a emits light. Since the bulb 1b has the downward light transmissive slit portion 3b, it emits light mainly in the downward direction. The bulb 1b emits light of the color corresponding to the phosphor layer 2b formed on the inner surface of the bulb 1b.

According to the first embodiment of the invention, there is provided a single fluorescent lamp of the aperture type, wherein the light transmissive slit portions 3a and 3b are situated in opposite directions. Since the light emission bulbs 1a and 1b are coupled by means of the coupler 8 to form the U-shaped discharge path 11, straight tubes may be employed as the light emission bulbs 1a and 1b, and the bending process involving heat softening is dispensed with. Thus, this prevents degradation of phosphor due to heat, variation in wall thickness of the bulb, and decrease in mechanical strength of the bulb.

The location of the slit portion 3a, 3b can be determined freely and easily by rotating the straight bulb 1a, lb about its axis. In addition, it is possible to prevent the location of the slit portion 3a, 3b from varying from lamp to lamp.

By selectively supplying electric power to the terminal electrodes 4a and 4b and the intermediate electrode 12, the region where electric discharge is caused to occur can be varied. Namely, the region of light emission and the amount of emitted light can be varied. Compared to the case where a number of independent lamps are used, the number of electrodes is reduced, and also the number of sockets and lamp holders is reduced. In addition, the wiring is simplified.

Figure 4:
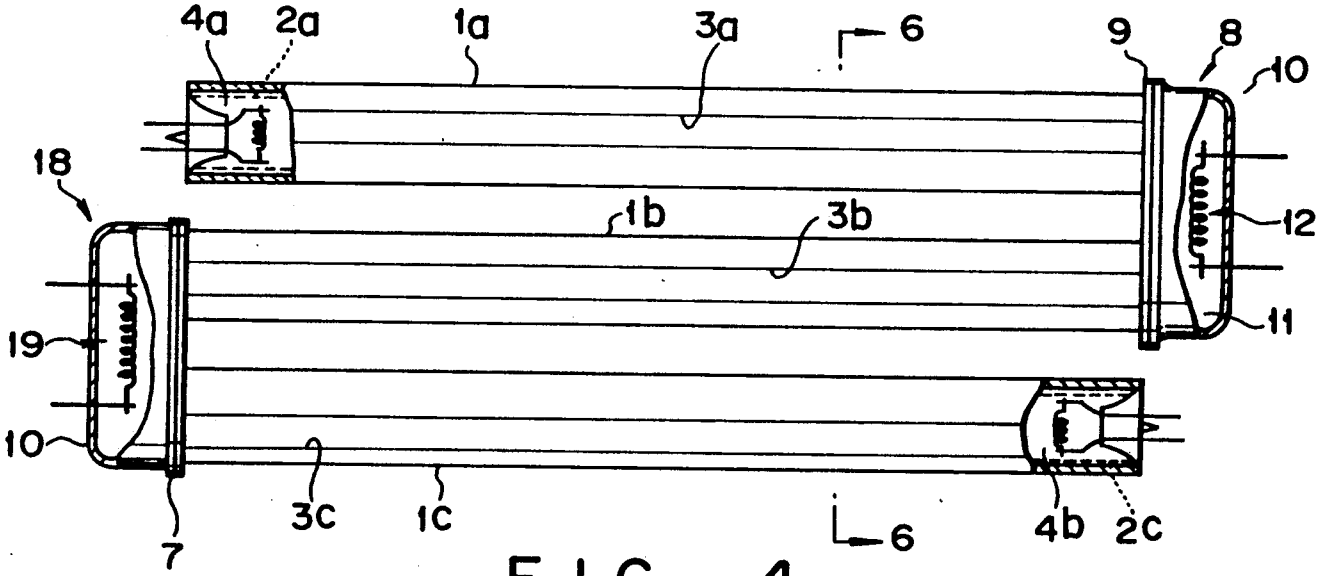
FIG. 4 is a side view of an aperture-type fluorescent lamp having an S-shaped discharge path, according to a second embodiment of the present invention.
Figure 6:
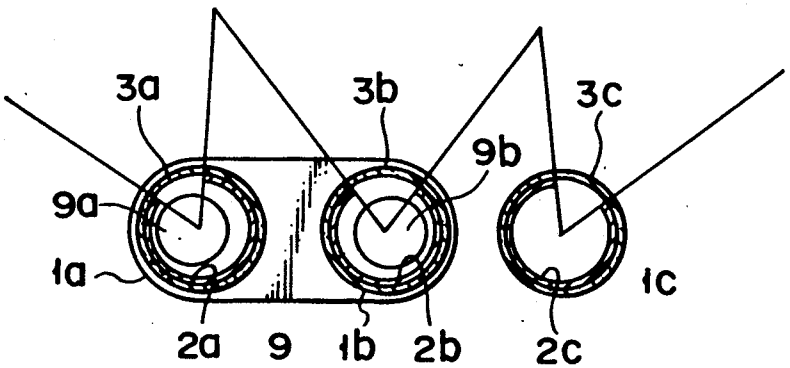
FIG. 6 is a cross-sectional view taken along line 6—6 in FIG. 4.
Figure 5:
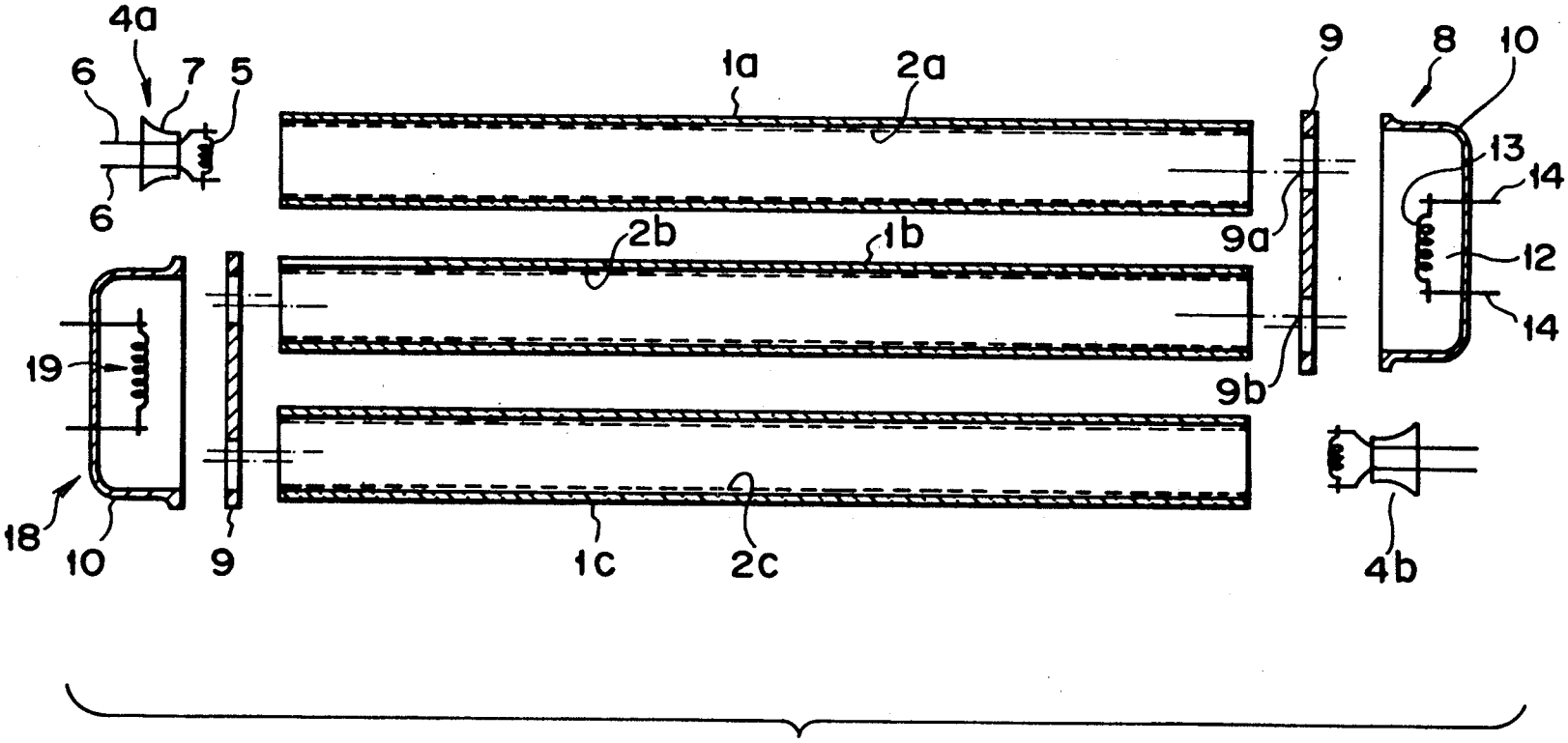
FIG. 5 is an exploded, vertical cross-sectional view of the fluorescent lamp shown in FIG. 4.

A second embodiment of the invention will now be described with reference to FIGS. 4 to 6.

The fluorescent lamp according the second embodiment employs three straight light emission bulbs 1a, 1b and 1c corresponding to the three primary colors, blue (B), green (G) and red (R). Phosphor layers 2a, 2b and 2c formed on the inner surfaces of the bulbs 1a, 1b and 1c can emit, respectively, blue-base light having a peak wavelength of, e.g. 453 nm, green-base light having a peak wavelength of, e.g. 543 nm, and red-base light having a peak wavelength of, e.g. 611 nm.

The light emission bulbs 1a, 1b and 1c have striplike light transmissive slit portions 3a, 3b and 3c which extend in the axis direction of the bulbs and are not coated with the phosphor layers 2a, 2b and 2c. In this embodiment, the slit portions 3a, 3b and 3c have the same width, but these are situated in different directions. The slit portion 3a faces on the upper left side, the slit portion 3b on the upper side, and the slit portion 3c on the upper right side.

End portions of the center bulb 1b and the third bulb 1c are connected by a coupler 18 having the same structure as the coupler 8 (employed to couple the bulbs 1a and 1b in the first embodiment). An intermediate electrode 19 is sealed in the coupler 18.

The straight light emission bulbs 1a, 1b and 1c and two couplers 8 and 18 constitute, as one body, a substantially N-shaped discharge path 11.

When electric power is supplied to terminal electrodes 4a and 4b provided at both ends of the discharge path 11, electric discharge is caused to occur between the terminal electrodes 4a and 4b. Since the electric discharge takes place over the entire length of the N-shaped discharge path 11, light is emitted from the entire N-shaped discharge path 11.

In this case, since the phosphor layers 2a, 2b and 2c of all bulbs 1a, 1b and 1c emit light simultaneously, blue light, green light and red light is simultaneously emitted.

The light emission bulbs 1a, 1b and 1c have striplike light transmissive slit portions 3a, 3b and 3c extending along the axes of the bulbs. Since the slit portions 3a, 3b and 3c are situated in different directions, e.g. an upper left direction, upper direction, and upper right direction, light is emitted in the directions of the slit portions 3a, 3b and 3c.

On the other hand, when electric power is supplied to the terminal electrode 4a, provided at one end of the discharge path 11, and the intermediate electrode 19, electric discharge takes place between the electrodes 4a and 19. Namely, the electric discharge occurs in the bulbs 1a and 1b, and the phosphor layers 2a and 2b emit light simultaneously. Thus, blue light and green light, for example, is emitted.

In this case, in accordance with the locations of the light transmissive slit portions 3a and 3b of bulbs 1a and 1b, light is emitted mainly in the upper left direction and in the upward direction.

When electric power is supplied to the terminal electrode 4b, provided at the other end of the discharge path 11, and the intermediate electrode 12, electric discharge takes place between the electrodes 4band 12. Namely, the electric discharge occurs in the bulbs 1b and 1c and phosphor layers 2b and 2c emit light simultaneously. In accordance with the locations of the light transmissive slit portions 3b and 3c, light is emitted mainly in the upward direction and in the upper right direction.

When electric power is supplied to the terminal electrode 4a and the intermediate electrode 12, electric discharge takes place between the electrodes 4a and 12 and only the phosphor layer 2a of the bulb 1a emits light. Thus, blue light, for example, is emitted mainly in the upper left direction through the slit portion 3a.

When electric power is supplied to the intermediate electrodes 12 and 19, electric discharge occurs between these electrodes 12 and 19 and only the phosphor layer 2b of the bulb 1b emits light. Thus, green light, for example, is emitted mainly in the upward direction through the slit portion 3b.

When electric power is supplied to the terminal electrode 4b and the intermediate electrode 19, electric discharge occurs between these electrodes 4b and 19 and only the phosphor layer 2c of the bulb 1c emits light. Thus, red light, for example, is emitted mainly in the upper right direction through the light transmissive slit portion 3c.

As has been described above, according to the second embodiment, there are provided six choices regarding the length of the bulb portion over which electric discharge takes place, and the region of the bulb portion through which light is emitted. In addition, the color of emitted light can be selected from six choices, and the direction of emitted light can be chosen.

In the above-described first and second embodiments, the locations or directions of the light transmissive slit portions 1a, 1b and 1c were varied in the respective bulbs; however, such locations or directions may be the same in the respective bulbs.

Figure 7:
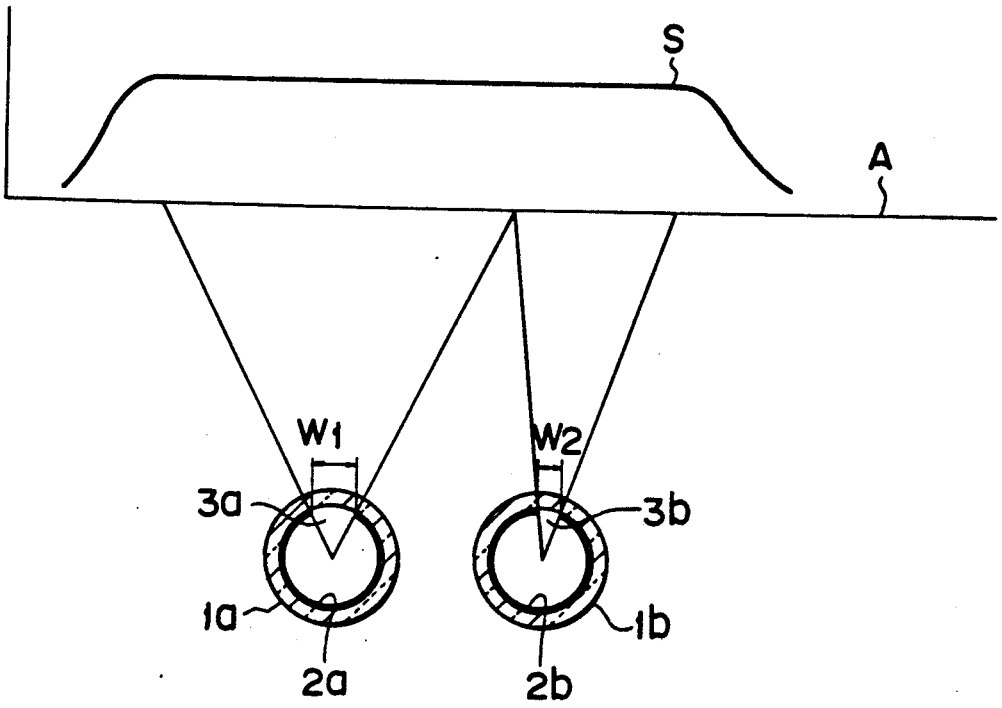
FIG. 7 is a transverse cross-sectional view of bulbs having apertures of different widths.

As is illustrated in FIG. 7, the light transmissive slit portions 1a and 1b of the bulbs 1a and 1b may have different widths W1 and W2 of the openings. In this case, for example, the distribution S of brightness on an illuminated surface A can be made uniform.

Figure 8:
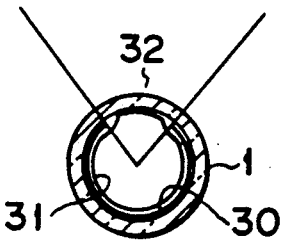
FIGS. 8 and 9 are transverse cross-sectional views of bulbs, showing arrangements of phosphor layers and reflective layers.

When the light transmissive slit portion, or the aperture portion, is formed in the fluorescent lamp, a simple glass light-transmissive portion not coated with phosphor may be formed, as mentioned above. Alternatively, as is shown in FIG. 8, a light-shield layer or a reflective layer 30 is formed on the inner surface of the bulb 1. In this case, a simple glass light-transmissive portion, on which the light-shield layer or reflective layer 30 is not formed. Then, a phosphor layer 31 is coated over the light-shield layer or reflective layer 30. The area where the light-shield layer or reflective layer 30 has not been formed serves as the light transmissive slit portion 32.

Figure 9:
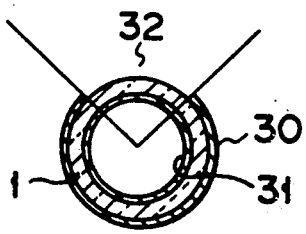
Figure 10:
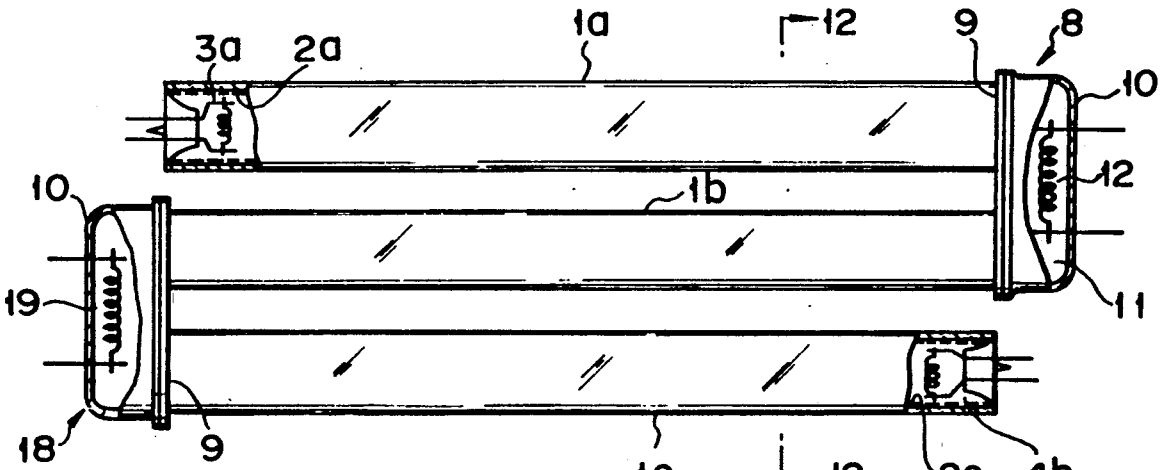
FIG. 10 is a side view of a fluorescent lamp having an S-shaped discharge path, according to a third embodiment of the invention, wherein the types of phosphor are varied.

In addition, as is illustrated in FIG. 9, the light-shield layer or reflective layer 30 may be formed on the outer surface of the bulb 1, with the light transmissive slit portion 32 being left.

In the above embodiments, the light emission bulb was constituted by coupling straight bulbs. In the present invention, however, a plurality of U-shaped light emission bulbs, for example, may be coupled.

In the above embodiments, each of the electrodes was the hot cathode; however, each electrode may be a cold cathode formed of a nickel plate.

In the case of a fluorescent lamp having cold cathodes, if the caps 10 of the couplers 8 and 18 are formed of an electrically conductive material, the caps 10 may also be used as the intermediate electrodes.

Furthermore, the present invention is not limited to the fluorescent lamp in which mercury is sealed. This invention is applicable to a noble gas discharge lamp in which xenon, neon, or krypton is sealed.

Referring to FIGS. 10 through 12B, there is shown a third embodiment of the present invention. The third embodiment relates to a fluorescent lamp having no apertures. Excepting the absence of apertures, the structure of the third embodiment is the same as that of the second embodiment shown in FIGS. 4 to 6. In the third embodiment, the types of phosphor layers 2a, 2b and 2c on the inner surfaces of the bulbs 1a, 1b and 1c differ from each other. By selecting the phosphor layers, light of different wavelengths can be emitted from the lamp.

Figure 12B:
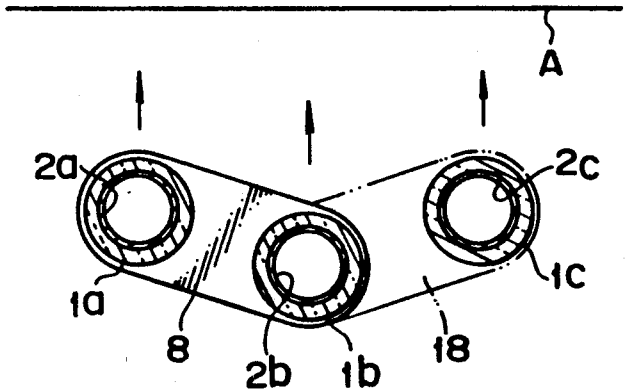
FIGS. 12A and 12B are cross-sectional views taken along line 12—12 in FIG. 10.
Figure 12A:
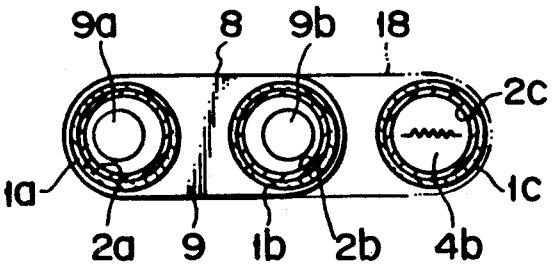
Figure 11:
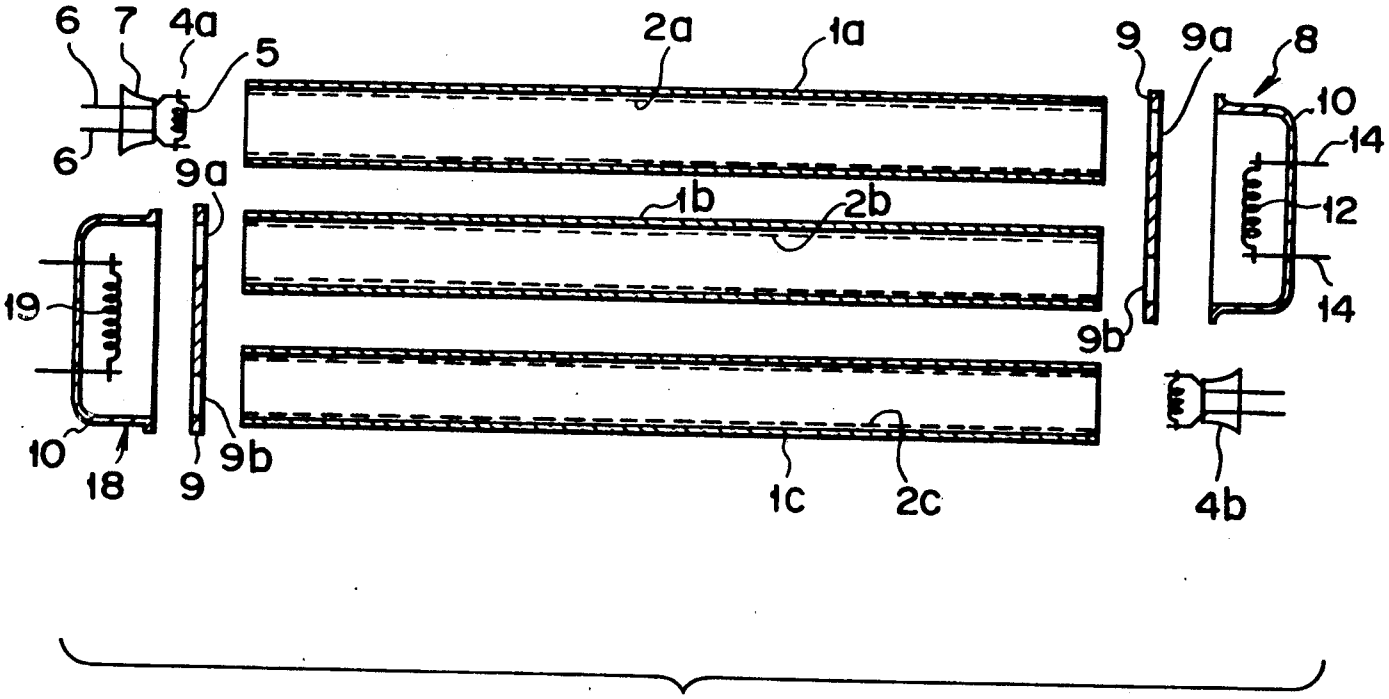
FIG. 11 is an exploded, vertical cross-sectional view of the fluorescent lamp shown in FIG. 10.
Figure 13:
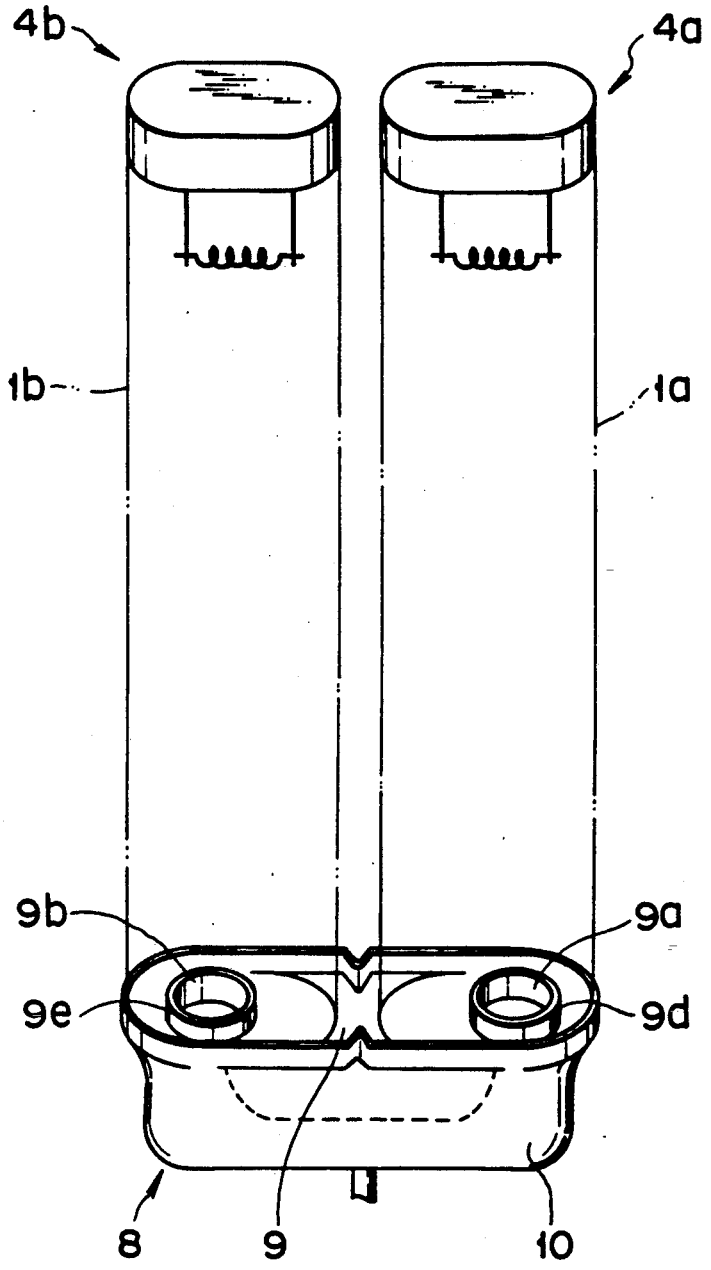
FIG. 13 is a perspective view of a fluorescent lamp with bulbs each having an oval cross section, according to a fourth embodiment of the invention.

The bulbs 1a, 1b and 1c may be linearly arranged in the same imaginary plane, as is shown in FIG. 12A, or they may be not, as is shown in FIG. 12B. In the case of the arrangement shown in FIG. 12B, the distance between the illuminated surface A and each bulb may be varied. If the distance between the surface A and the center bulb 1b is made greater than that between the surface A and the bulbs 1a and 1c, the surface A can be uniformly illuminated.

Figure 14:
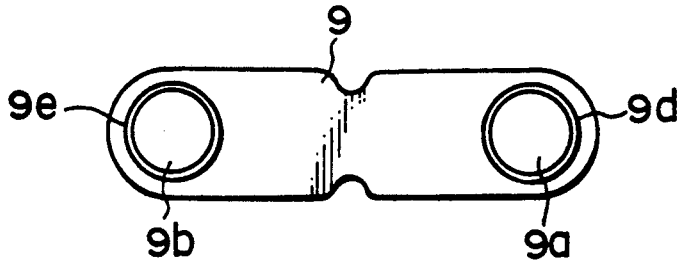
FIG. 14 a front view of the cap portion shown in FIG. 14.

FIGS. 12 and 14 show a fluorescent lamp according to a fourth embodiment of the invention. The structure of the fourth embodiment is the same as that of the first embodiment shown in FIG. 1, except that the cross section of each of the bulbs 1*a* and 1*b* is oval, no aperture is formed, and the communication ports 9*a* and 9*b* have special structure. According to the fourth embodiment, since the cross section of the bulb 1*a*, 1*b* is oval, the area facing the illuminated surface is large, and illumination can be performed with high efficiency and uniform illuminance.

In the case where the bulb 1*a*, 1*b* has an oval cross section, the inward displacement of the positive column in the curved area of the discharge path 11 is considerably great. Thus, in the fourth embodiment, a cylindrical member 9*d*, 9*e* is provided to surround a discharge port 9*a*, 9*b*, so that the discharge port 9*a*, 9*b* may have a higher compensation effect for the displacement of the positive column.

Figure 15:
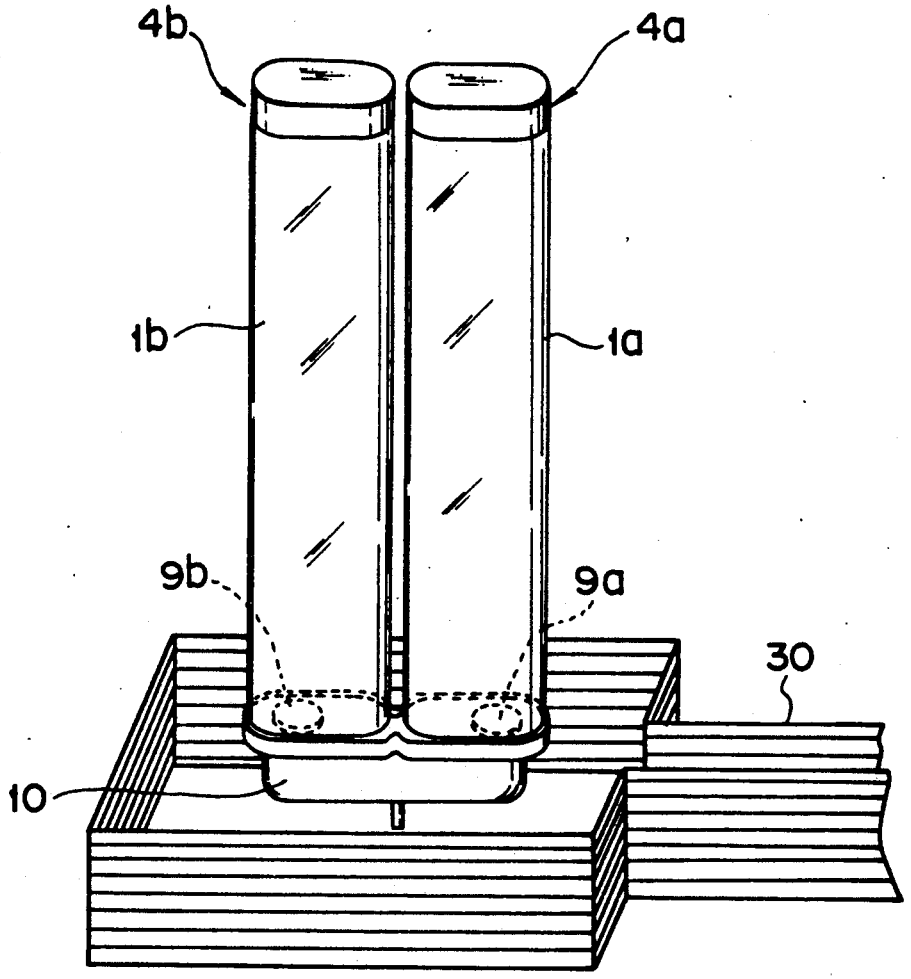
FIG. 15 is a perspective view for illustrating an apparatus for manufacturing, for example, the fluorescent lamp shown in FIG. 13.

FIG. 15 illustrates an apparatus and a method for manufacturing the above-described fluorescent lamp. The bulbs 1*a* and 1*b* and the caps 10 and 19 are coupled by means of frit glass, etc. In this case, a coupling material of frit glass is interposed between the bulbs and the caps. The bulbs and the caps are held in a predetermined position by a suitable jig. The end portions of the caps and bulbs are placed in a radio-frequency heating coil 30, as is shown in FIG. 15. The radio-frequency heating coil is driven to heat the metallic caps, thereby coupling the the caps and the bulbs Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A fluorescent lamp having a curved discharge path, comprising:

at least first and second linear tubular bulbs forming a portion of said curved discharge path, said first and second bulbs being arranged in a predetermined positional relationship and each bulb having a phosphor coating;

at least one cap interconnecting end portions of said first and second bulbs and constituting in combination with said first and second bulbs said curved discharge path;

terminal electrodes provides at end portions of said first and second bulbs constituting ends of said curved discharge path for enabling said curved discharge path to emit light;

an intermediate electrode provided within said cap, said intermediate electrode and said terminal electrodes, selectively enabling one of said at least first and second bulbs to emit light; and a seal plate having communication ports provided in a connection part between said first and second bulbs and said cap, the inside of each bulb being allowed to communicate with the inside of said cap through said communication ports, and the position of each communication port being displaced from a center of a cross section of each bulb towards the outside of a curved area of said curved discharge path.

2. The fluorescent lamp according to claim 1, wherein said first and second bulbs have a transmissive slit portion.

3. The fluorescent lamp according to claim 2, wherein said transmissive slit portions of said first and second bulbs have different widths.

4. The fluorescent lamp according to claim 2, wherein said transmissive slit portions of said first and second bulbs are situated in different positions along the circumference of each bulb.

5. The fluorescent lamp according to claim 1, wherein the types of phosphor coating on the inner surfaces of said first and second bulbs differ from each other, and said phosphor coatings emit light of different wavelengths.

6. The fluorescent lamp according to claim 1 wherein each of said first and second bulbs has an oval cross section.

* * * * *